US006741822B2

(12) United States Patent
Ishiguro et al.

(10) Patent No.: US 6,741,822 B2
(45) Date of Patent: May 25, 2004

(54) IMAGE FORMING APPARATUS WITH MEMBERS FOR HOLDING A CARTRIDGE

(75) Inventors: Yasuyuki Ishiguro, Higashiosaka (JP); Wataru Yoshida, Hirakata (JP); Toshihide Ohgoshi, Nara (JP); Toshio Nishino, Yamatokoriyama (JP); Atsushi Inoue, Nara (JP); Takahiko Kimura, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/121,582

(22) Filed: Apr. 15, 2002

(65) Prior Publication Data

US 2002/0172533 A1 Nov. 21, 2002

(30) Foreign Application Priority Data

May 16, 2001 (JP) ..... 2001-146743

(51) Int. Cl.[7] ..... G03G 15/08

(52) U.S. Cl. ..... 399/119; 399/222; 399/252; 399/262

(58) Field of Search ..... 399/110, 159, 399/222, 252, 258, 262, 111, 279, 119, 120

(56) References Cited

U.S. PATENT DOCUMENTS 5,802,431 A * 9/1998 Nagashima et al. ..... 399/262
5,956,546 A 9/1999 Tsuchiya

FOREIGN PATENT DOCUMENTS

JP 09-230694 A 9/1997

* cited by examiner

*Primary Examiner*—William J. Royer
(74) *Attorney, Agent, or Firm*—Birch, Stewart, Kolasch & Birch, LLP

(57) ABSTRACT

Elastic members are fixed at one end to the housing of an image forming apparatus while their distal ends extend into the framework of the developing unit. When a toner cartridge is fitted to the framework of a developing unit, the distal ends of the elastic members abut the top surface of the toner cartridge, so that the elastic members are compressed to produce repulsive force, which in turn causes the developing unit to rotate clockwise about a support so as to bring the developer roller into pressing contact with a photoconductor.

4 Claims, 7 Drawing Sheets

IMAGE FORMING APPARATUS WITH MEMBERS FOR HOLDING A CARTRIDGE

BACKGROUND OF THE INVENTION (1) Field of the Invention

The present invention relates to an image forming apparatus such as a copier, printer, facsimile machine or the like and a toner cartridge for use in the same apparatus.

(2) Description of the Prior Art

A typical image forming apparatus based on an electrophotographic process reproduces images by the steps of forming an electrostatic latent image on a photoconductor surface, developing the electrostatic latent image by using a development unit device to create a toner image and transferring the toner image to printing paper.

Generally, the developing unit is mainly comprised of a developer roller for making toner adhere to the photoconductor surface to form toner images and a toner container for supplying the toner to the developer roller. For user's convenience or improvement in service performance, the toner container is usually made of a cartridge so as to allow users to readily replace the cartridge.

Since this cartridge configuration enables users to do maintenance of the image forming apparatus by themselves without leaving the maintenance in the charge of professional service persons, it is possible to markedly improve the operativity.

In such cartridge type configurations, a toner cartridge is attached first to a developing unit, then the developing unit is positioned by a mechanically operating device(e.g., leverage action) so that its developer roller comes into pressing contact with a photoconductor. When the toner inside the toner cartridge is consumed and runs out from repeated cycles of image reproduction, the used toner cartridge should be removed and replaced with a new toner cartridge by releasing the pressing force of the developer roller acting on the photoconductor by the mechanically operating device.

However, such a conventional image forming apparatus as described above faces the problem of becoming complex in machine configuration because of the necessity of a mechanically operating device for making pressing contact between the photoconductor and developer roller and the problem that the image forming apparatus could be broken by a wrong handling of the mechanically operating device.

Another problem with the mechanically operating device is that it is difficult to establish uniform pressing contact between the photoconductor and developer roller. This problem occurs due to inclusion of springs in the mechanically operating device. That is, in order for the developer roller to come in uniform contact with the photoconductor, it is necessary that a multiple number of springs should present equal strength of repulsive force. However, as a result of use of a mechanically operating device, the dimensional tolerance and assembly accuracy tolerance of the constituent parts and their dimensional changes due to deformation when the mechanically operating device is operated and other errors build up, hence the spring lengths become different one from another, causing imbalance in strength of repulsive force between the springs.

SUMMARY OF THE INVENTION

The present invention has been achieved in view of the above circumstances, and it is therefore an object of the present invention to provide an image forming apparatus with a toner cartridge for use therein, having a simple configuration which allows easy replacement of the toner cartridge and enables a developer roller to abut a photoconductor with a uniform distribution of pressure across the length of the developer roller.

In order to achieve the above object, the arrangement of the image forming apparatus with a toner cartridge according to the present invention uses the following configurations.

A first feature of the present invention resides in an image forming apparatus comprising: a photoconductor which is effective to have latent images formed on the surface thereof; a developing unit having a developer roller rotatably supported by a framework thereof for making toner adhere to the photoconductor surface so as to form a toner image; a toner cartridge removably attached to the framework of the developing unit for supplying toner to the developer roller; and a housing for covering the photoconductor and developing unit, wherein elastic members fixed at one end thereof to the housing are provided, and when the toner cartridge is set into the framework of the developing unit, distal ends of the elastic members abut the toner cartridge so that the elastic members are compressed to produce repulsive force, which acts on the developer roller by way of the toner cartridge and framework so that the developer roller comes into pressing contact with the photoconductor.

A second feature of the present invention resides in the image forming apparatus having the above first feature and being characterized in that the developing unit has a support shaft supported by the housing and is caused to rotate by the repulsive force of the elastic members so that the developer roller comes into pressing contact with the photoconductor.

A third feature of the present invention resides in the image forming apparatus having the above first feature and being characterized in that the toner cartridge is formed with projections at positions against which the elastic members are abutted.

A fourth feature of the present invention resides in the image forming apparatus having the above second feature and being characterized in that the toner cartridge is formed with projections at positions against which the elastic members are abutted.

According to the first feature of the present invention, the elastic members fixed at one end thereof to the housing are provided, and when the toner cartridge is set into the framework of the developing unit, the distal ends of the elastic members abut the toner cartridge so that the elastic members are compressed to produce repulsive force, which acts on the developer roller by way of the toner cartridge and framework so that the developer roller comes into pressing contact with the photoconductor.

According to the second feature of the present invention, since the developing unit has a support shaft that is supported by the housing, the developing unit is caused to rotate by the repulsive force of the elastic members so that the developer roller comes into pressing contact with the photoconductor.

According to the third and fourth features of the present invention, since projections are formed at positions against which the elastic members are abutted, the repulsive force is received by projections alone when the toner cartridge is attached to the developing unit.

DESCRIPTION OF THE PREFERRED EMBODIMENTS

Embodiments of image forming apparatuses and toner cartridges used therein according to the present invention will be described with reference to the accompanying drawings.

Figure 1:
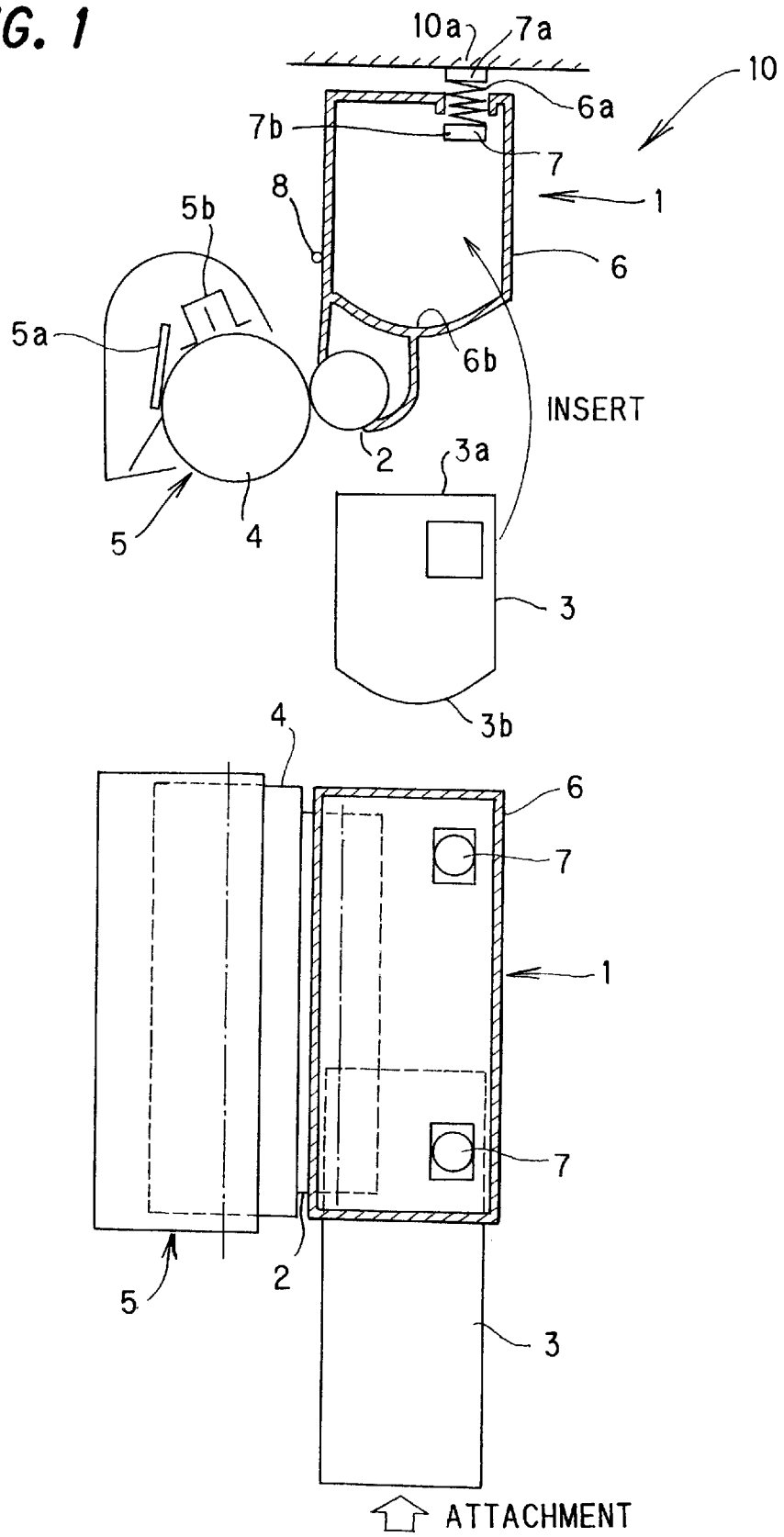
FIG. 1 is a view (before attachment of a toner cartridge) showing an image forming apparatus and a toner cartridge for use therein according to a first embodiment of the present invention.
Figure 2:
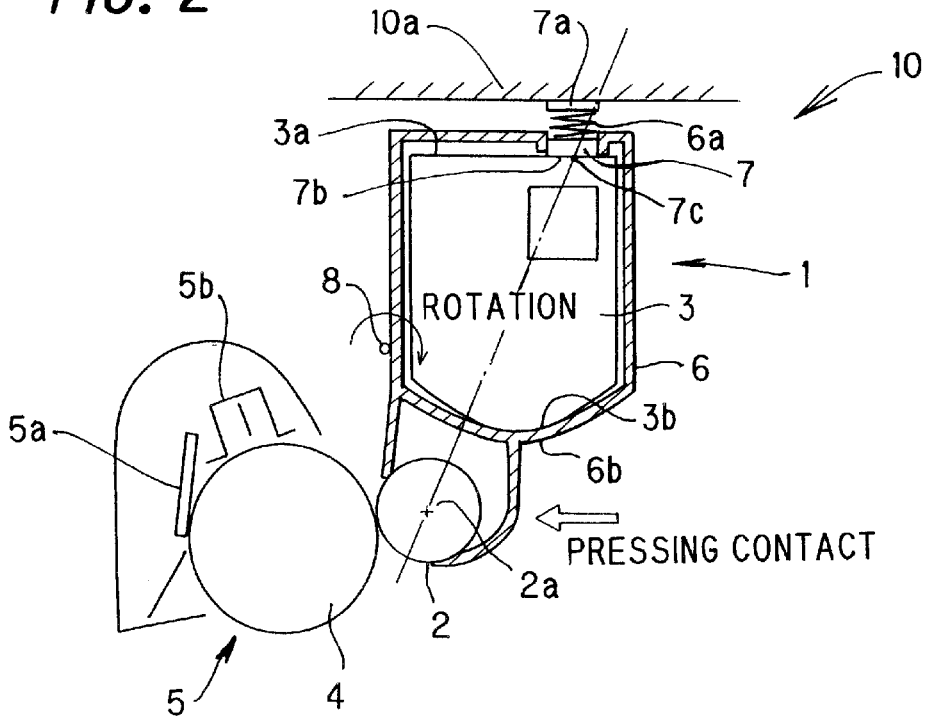
FIG. 2 is a view (after attachment of a toner cartridge) showing an image forming apparatus and a toner cartridge for use therein according to the first embodiment of the present invention.
Figure 2:
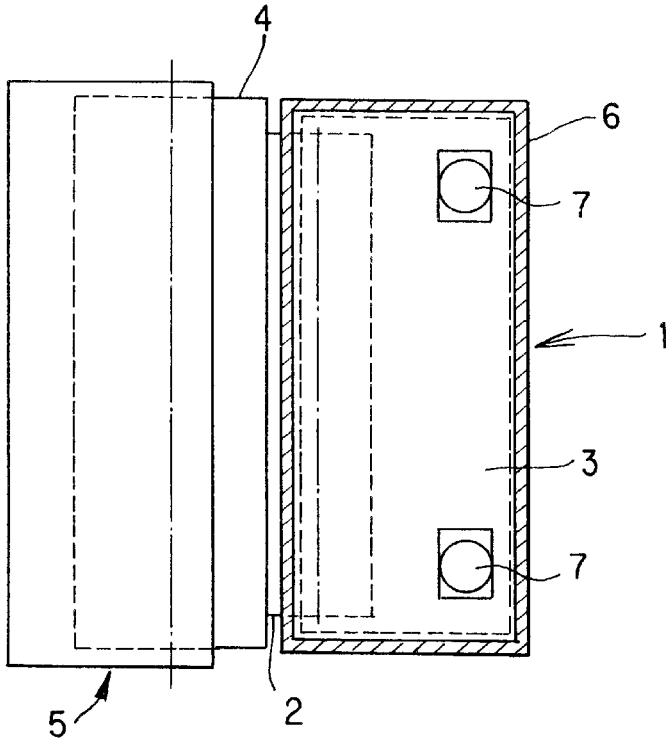
Figure 3:
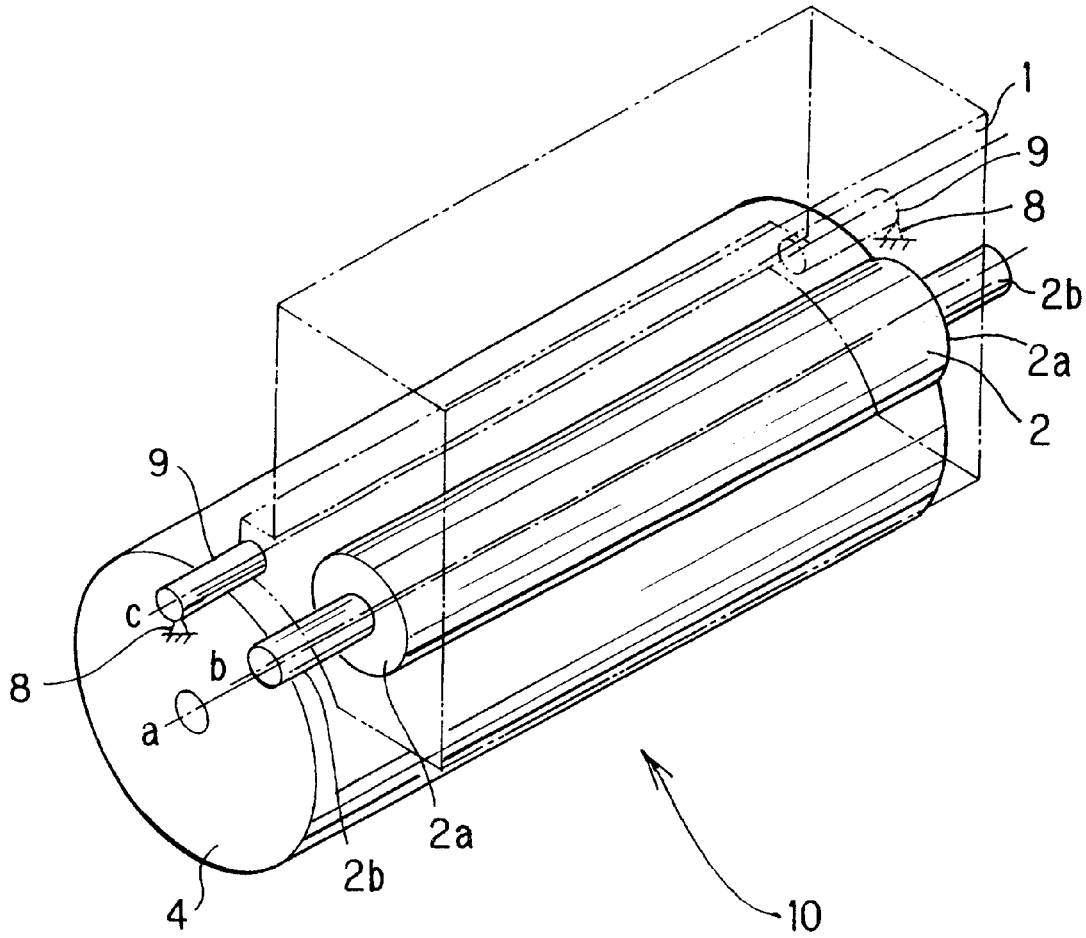
FIG. 3 is a perspective view showing an image forming apparatus according to the present invention.

FIGS. 1 to 3 are illustrations showing an image forming apparatus and a toner cartridge according to a first embodiment of the present invention.

An image forming apparatus 10 is mainly comprised of a developing unit 1, a toner cartridge 3, a drum cartridge 5 and elastic members 7.

Developing unit 1 is generally composed of a developer roller 2, a framework 6 and a support 8.

Developer roller 2 has a cylindrical configuration with support shaft 2*b* extended from both end faces 2*a* so that the support shaft 2*b* is rotatably supported by framework 6 of developing unit 1. Developer roller 2 causes the toner supplied from toner cartridge 3 to adhere to the surface of a photoconductor 4 so as to form toner images and is abutted against photoconductor 4 when toner cartridge 3 is set in place.

Framework 6 is a structure that supports developer roller 2 and toner cartridge 3 and is configured so as to allow toner cartridge 3 to be attached to and removed from the framework 6. Windows 6*a* are formed in framework 6 so as to permit distal ends 7*a* of the elastic members 7 to face the interior of framework 6. When toner cartridge 3 is mounted, the repulsive force of elastic members 7 acts on toner cartridge 3 and presses framework 6 so as to urge developing roller 2 against photoconductor 4.

Support 8 is to support developing unit 1 with respect to image forming apparatus 10 and is arranged on the photoconductor side with respect to a line joining a point 7*c* of force applied from elastic members 7 onto toner cartridge 3 and the rotational center of end face 2*a* of developer roller 2, so that when developing unit 1 rotates about support 8, developer roller 2 of developing unit 1 comes into pressing contact with photoconductor 4. The support 8 is provided in the form of a support shaft 9, which is rotationally supported at its ends by a housing 10*a* (FIGS. 1 and 2) of the image forming apparatus 10.

Toner cartridge 3 is configured so as to be attached to and removed from framework 6 of developing unit 1 and holds toner therein.

Drum cartridge 5 includes photoconductor 4 of a cylindrical form, and a cleaning means 5*a*, a charger 5*b* and other compartments arranged around the photoconductor 4. The drum cartridge 5 can be attached to and removed from housing 10*a* (FIGS. 1 and 2) of the image forming apparatus 10.

Each elastic member 7 is fixed at its distal end 7*a* to housing 10*a* of image forming apparatus 10 while the other end 7*b* extends into framework 6 through window 6*a* of framework 6 of developing unit 1. Elastic members 7 can be provided in any form as long as the elastic members can produce repulsive force when compressed. For example, a compression coil spring can be used.

The center axis b of developer roller 2 of developing unit 1, the center axis a of photoconductor 4 and the center axis 'c' of support shaft 9 are arranged in parallel with each other.

Next, description will be made of the operation when toner cartridge 3 is mounted to the image forming apparatus 10 thus configured.

When toner cartridge 3 is attached to framework 6 of developing unit 1, distal ends 7*a* of elastic members 7 abut top surface 3*a* of toner cartridge 3 so as to compress the elastic members 7, whereby their repulsive force acts on the top surface 3*a* of toner cartridge 3. This repulsive force is transmitted to the bottom 6*b* of framework 6 against which the underside 3*b* of toner cartridge 3 abuts and causes developing unit 1 to rotate clockwise about support 8, whereby developer roller 2 of developing unit 1 is brought into pressing contact with photoconductor 4.

When toner cartridge 6 is removed from framework 3 of developing unit 1, the pressure of developer roller 2 against photoconductor 4 is released.

In the above way, according to the first embodiment, since mere attachment of toner cartridge 3 to developing unit 1 makes it possible to cause developer roller 2 of developing unit 1 to come into pressing contact with photoconductor 4, it is possible to realize easy replacement of toner cartridge 3. Since no mechanically operating means(operating lever or the like) is needed, the apparatus configuration can be simplified and it is possible to prevent uneven distribution of the contact force between photoconductor 4 and developer roller 2.

Next, a second embodiment of an image forming apparatus and a toner cartridge used therein according to the present invention will be described. FIGS. 4A to 7 are illustrations showing image forming apparatuses and toner cartridges according to the second embodiment of the present invention. Like components as those in the first embodiment are identified with like reference numerals and their detailed description is omitted.

Figure 4A:
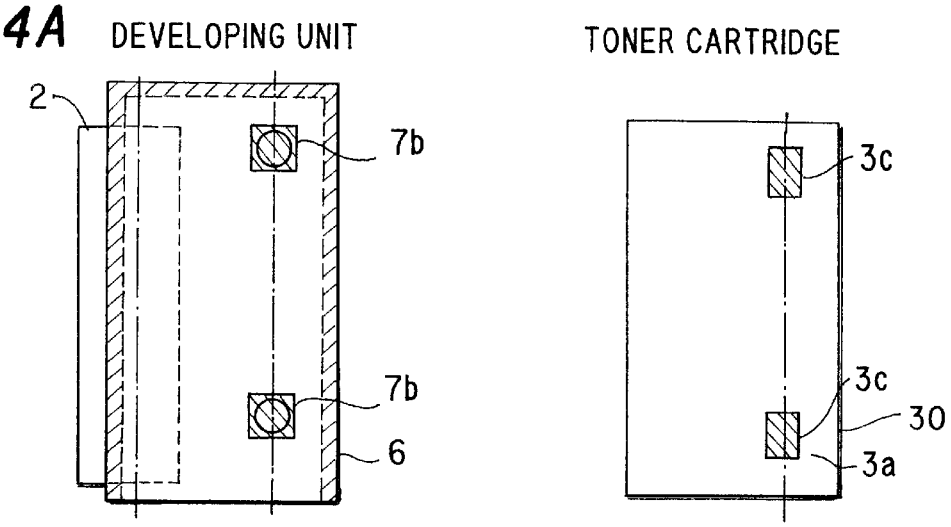
FIGS. 4A, 4B and 4C are front views showing image forming apparatuses and toner cartridges used therein according to a second embodiment of the present invention.
Figure 4B:
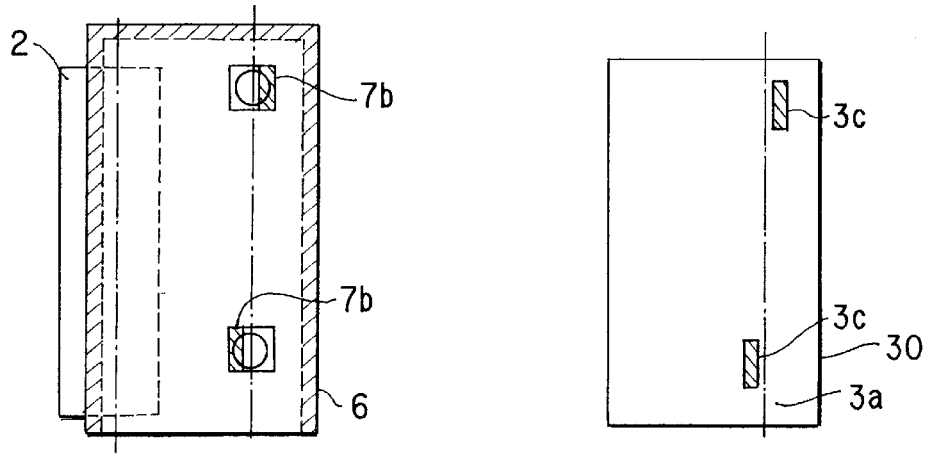
Figure 4C:
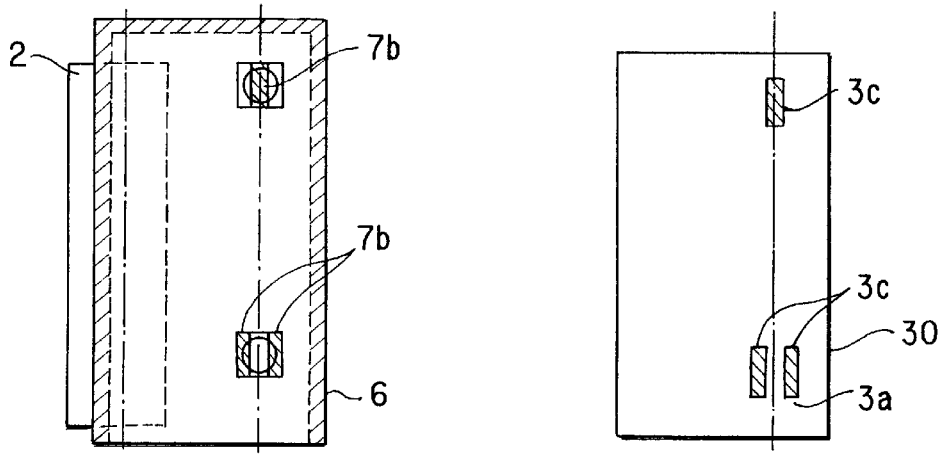
Figure 5:
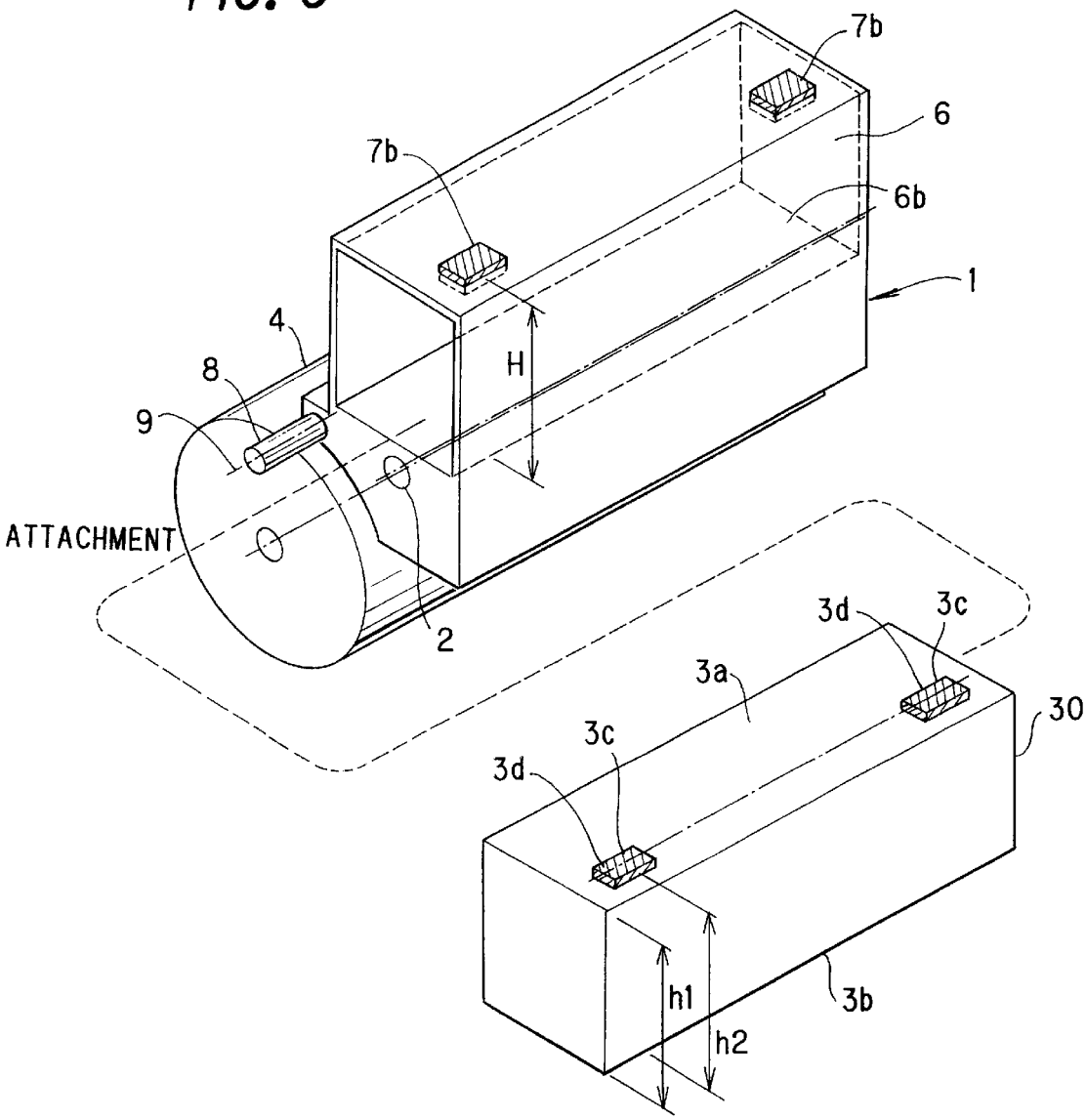
FIG. 5 is a perspective view showing the configuration shown in FIG. 4A according to the second embodiment.
Figure 6:
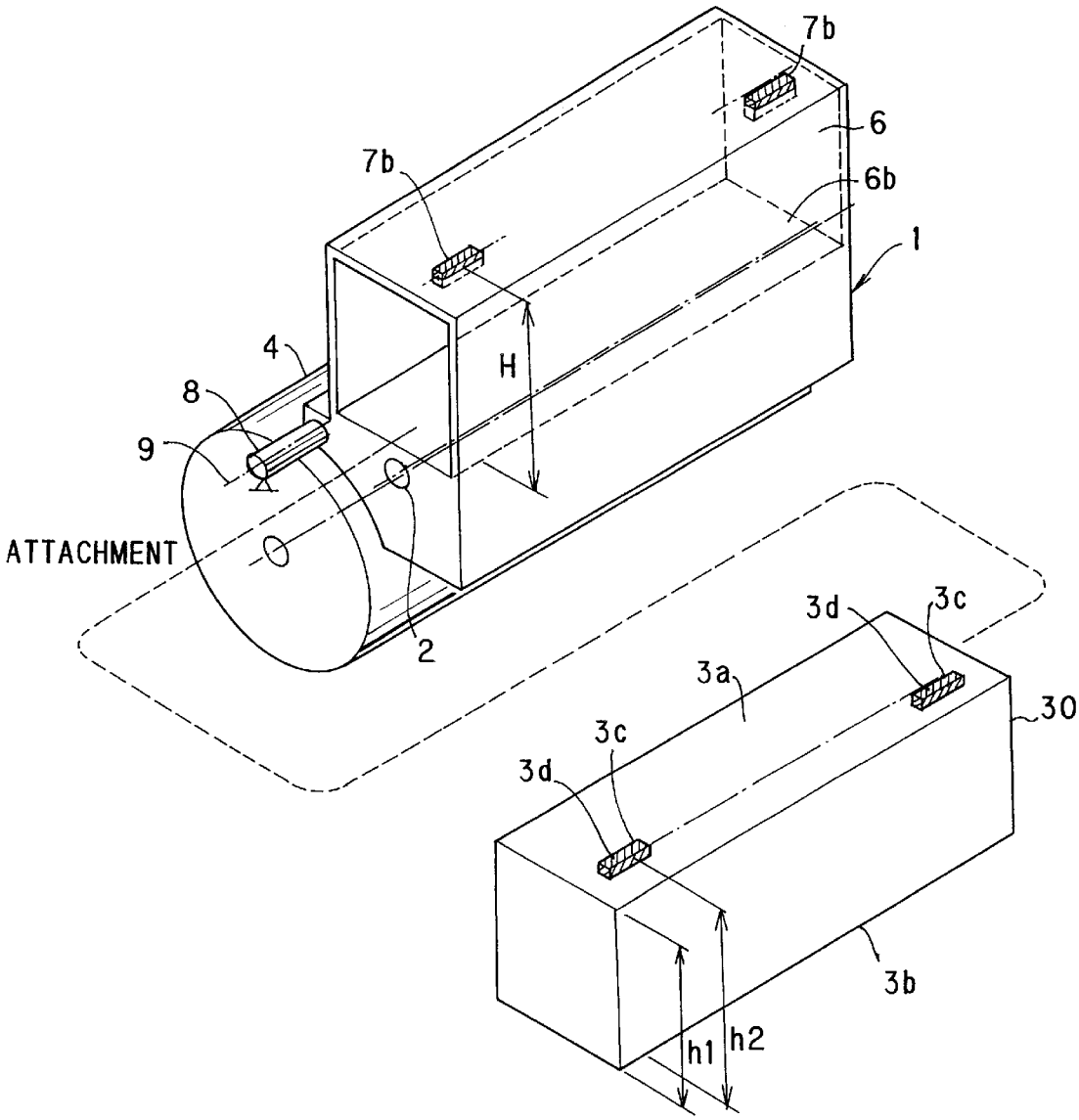
FIG. 6 is a perspective view showing the configuration shown in FIG. 4B according to the second embodiment.
Figure 7:
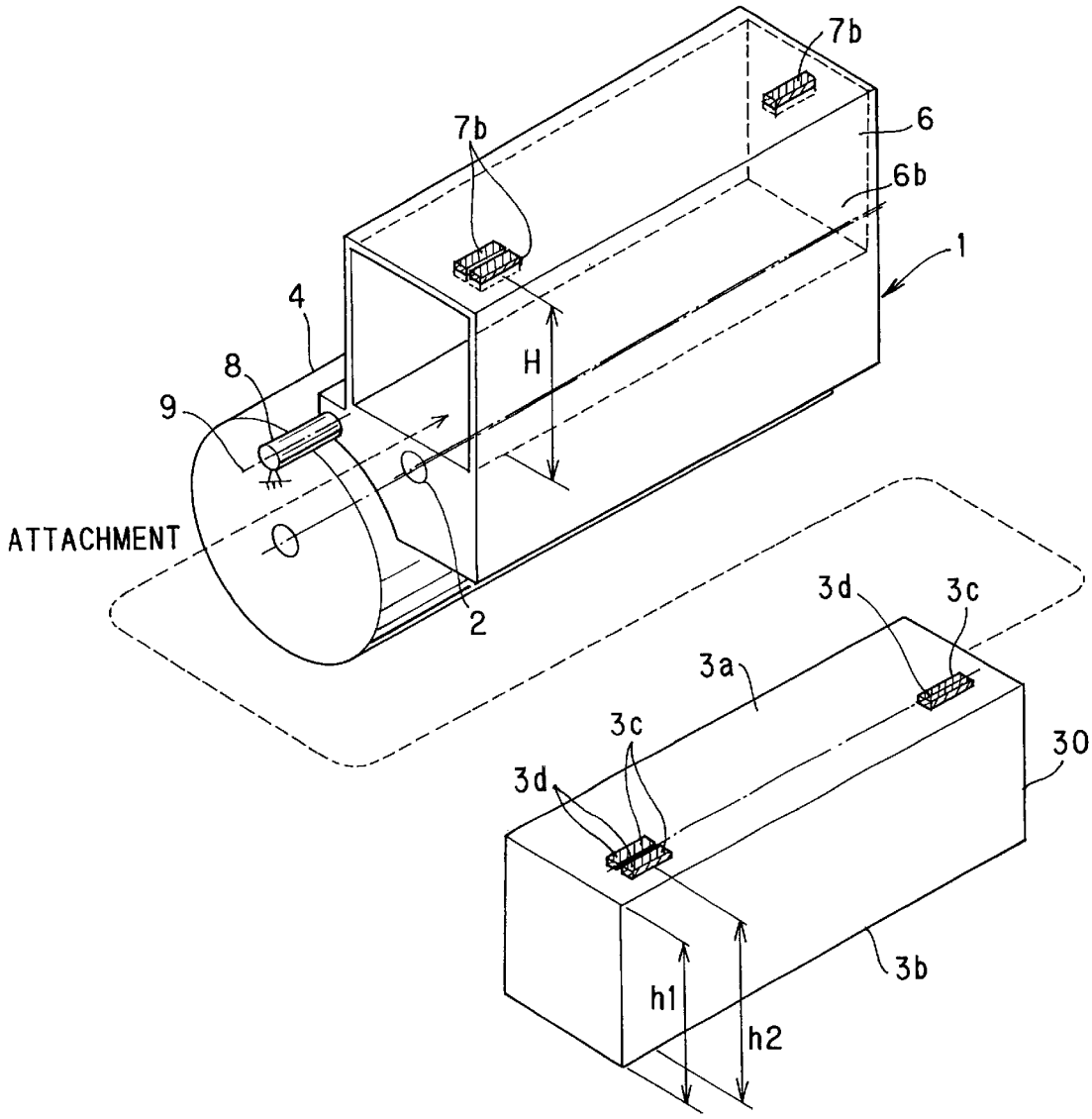
FIG. 7 is a perspective view showing the configuration shown in FIG. 4C according to the second embodiment.

As shown in FIGS. 4A to 7, with concern to each image forming apparatus of the second embodiment and a toner cartridge 30 used therein, projections 3*c* are formed on the top surface 3*a* of toner cartridge 30 at positions corresponding to the positions of distal ends 7*a* of elastic members 7. For example, as shown in FIGS. 4A and 5, multiple projections 3*c* are provided at ends of the toner cartridge. Alternatively, as shown in FIGS. 4B and 6, and as shown in FIGS. 4C and 7, multiple projections 3*c* are formed at non-aligned positions on a plane perpendicular to an insert direction of the toner cartridge. In this case, a vertical distance H from the bottom 6*b* of framework 6 to the distal end 7*a* of elastic members 7 is set to be greater than a vertical distance h1 from the underside 3*b* to the top surface 3*a* of toner cartridge 30 and smaller than a vertical distance h2 from the underside 3*b* of toner cartridge 30 to the top surface 3*d* of projections 3*c*.

According to the second embodiment, when toner cartridge 30 is inserted and fitted in framework 6 of developing unit 1, the repulsive force of elastic members 7 acts on projections 3*c* of toner cartridge 30 alone (or elastic members 7 will not abut areas other than projections 3*c* on the top surface 3*a* of toner cartridge 30 when toner cartridge 30 is inserted). Therefore, it is possible to smoothly set toner cartridge 30. In particular, in the case shown in FIGS. 4B and 6 and in the case shown in FIGS. 4C and 7, it is possible to act the repulsive force of elastic members 7 on projections 3*c* on toner cartridge 30 at individual points.

As has been described heretofore, according to the present invention, since mere attachment of the toner cartridge to the developing unit makes it possible to cause the developer roller of the developing unit to come into pressing contact with the photoconductor, this configuration makes it possible to realize easy replacement of toner cartridges. Further, since no mechanically operating means(operating lever or the like) is needed, the machine configuration can be simplified and resultantly it is possible to prevent uneven distribution of the contact force between the photoconductor and developer roller.

What is claimed is:

1. An image forming apparatus comprising:

a photoconductor effective to have electrostatic latent images formed on the surface thereof;

a developing unit having a developer roller rotatably supported by a framework thereof for making toner adhere to the surface of the photoconductor so as to form a toner image;

a toner cartridge removably attached to the framework of the developing unit for supplying toner to the developer roller; and a housing for covering the photoconductor and developing unit, the image forming apparatus including elastic members fixed at one end thereof to the housing are provided, and when the toner cartridge is set into the framework of the developing unit, distal ends of the elastic members abut the toner cartridge so that the elastic members are compressed to produce a repulsive force, which acts on the developer roller by way of the toner cartridge and framework so that the developer roller comes into pressing contact with the photoconductor.

2. The image forming apparatus according to claim 1, wherein the developing unit has a support shaft to be supported by the housing and is caused to rotate by the repulsive force of the elastic members so that the developer roller comes into pressing contact with the photoconductor.

3. The image forming apparatus according to claim 2, wherein the toner cartridge is formed with projections at positions against which the elastic members are abutted.

4. The image forming apparatus according to claim 1, wherein the toner cartridge is formed with projections at positions against which the elastic members are abutted.

* * * * *